US006220506B1

(12) United States Patent
Knight

(10) Patent No.: US 6,220,506 B1
(45) Date of Patent: Apr. 24, 2001

(54) BEVERAGE DRINKING BOX

(76) Inventor: Lynette M. Knight, 12850 Belle Aire Dr., Champlin, MN (US) 55316

( * ) Notice: Subject to any disclaimer, the term of this patent is extended or adjusted under 35 U.S.C. 154(b) by 0 days.

(21) Appl. No.: 09/301,784

(22) Filed: Apr. 29, 1999

(51) Int. Cl.[7] ..... B65D 5/465

(52) U.S. Cl. ..... 229/117.22; 229/103.1; 229/117.09

(58) Field of Search ..... 229/117.09, 117.22, 229/117.23, 117.24, 117.25, 117.26, 103.1; 206/427; 220/772

(56) References Cited

U.S. PATENT DOCUMENTS

D. 269,253 * 6/1983 Gagnon ..... D9/434
1,194,172 * 8/1916 Harbeck ..... 229/117.23
1,505,594 * 8/1924 Grueberg ..... 229/117.09
3,338,394 * 8/1967 Hennessey ..... 206/427
4,120,073 * 10/1978 Studebaker ..... 16/114 R
4,557,392 * 12/1985 Ryan et al. ..... 220/772
4,741,073 * 5/1988 Capen ..... 16/114 R
4,889,376 * 12/1989 Nagy ..... 294/33
4,905,888 * 3/1990 Suoss et al. ..... 229/117.22
4,982,989 * 1/1991 Sweeny ..... 294/171
5,294,018 * 3/1994 Boucher ..... 220/772
5,437,594 * 8/1995 Mattson et al. ..... 493/88
5,671,864 * 9/1997 Caruthers ..... 220/772
5,823,422 * 10/1998 Collier et al. ..... 229/103.1

* cited by examiner

*Primary Examiner*—Gary E. Elkins

(57) ABSTRACT

A new beverage drinking box for PURPOSE. The inventive device includes a beverage carton for holding a fluid beverage therein. A pair of handles are coupled to opposite sides of the beverage carton.

11 Claims, 2 Drawing Sheets

BEVERAGE DRINKING BOX

BACKGROUND OF THE INVENTION

1. Field of the Invention

The present invention relates to drinking boxes and more particularly pertains to a new beverage drinking box for PURPOSE.

2. Description of the Prior Art

The use of drinking boxes is known in the prior art. More specifically, drinking boxes heretofore devised and utilized are known to consist basically of familiar, expected and obvious structural configurations, notwithstanding the myriad of designs encompassed by the crowded prior art which have been developed for the fulfillment of countless objectives and requirements.

Known prior art devices for holding beverage cartons include U.S. Pat. No. 4,741,073; U.S. Pat. No. 4,120,073; U.S. Pat. No. 4,889,376; U.S. Pat. No. 5,437,594; U.S. Pat. No. 4,982,989; and U.S. Pat. No. Des. 269,253.

While these devices fulfill their respective, particular objectives and requirements, the aforementioned patents do not disclose a new beverage drinking box. The inventive device includes a beverage carton for holding a fluid beverage therein. A pair of handles are coupled to opposite sides of the beverage carton.

In these respects, the beverage drinking box according to the present invention substantially departs from the conventional concepts and designs of the prior art, and in so doing provides an apparatus primarily developed for the purpose of PURPOSE.

SUMMARY OF THE INVENTION

In view of the foregoing disadvantages inherent in the known types of drinking boxes now present in the prior art, the present invention provides a new beverage drinking box construction wherein the same can be utilized for PURPOSE.

The general purpose of the present invention, which will be described subsequently in greater detail, is to provide a new beverage drinking box apparatus and method which has many of the advantages of the drinking boxes mentioned heretofore and many novel features that result in a new beverage drinking box which is not anticipated, rendered obvious, suggested, or even implied by any of the prior art drinking boxes, either alone or in any combination thereof.

To attain this, the present invention generally comprises a beverage carton for holding a fluid beverage therein. A pair of handles are coupled to opposite sides of the beverage carton.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new beverage drinking box apparatus and method which has many of the advantages of the drinking boxes mentioned heretofore and many novel features that result in a new beverage drinking box which is not anticipated, rendered obvious, suggested, or even implied by any of the prior art drinking boxes, either alone or in any combination thereof.

It is another object of the present invention to provide a new beverage drinking box which may be easily and efficiently manufactured and marketed.

It is a further object of the present invention to provide a new beverage drinking box which is of a durable and reliable construction.

An even further object of the present invention is to provide a new beverage drinking box which is susceptible of a low cost of manufacture with regard to both materials and labor, and which accordingly is then susceptible of low prices of sale to the consuming public, thereby making such beverage drinking box economically available to the buying public.

Still yet another object of the present invention is to provide a new beverage drinking box which provides in the apparatuses and methods of the prior art some of the advantages thereof, while simultaneously overcoming some of the disadvantages normally associated therewith.

Still another object of the present invention is to provide a new beverage drinking box for PURPOSE.

Yet another object of the present invention is to provide a new beverage drinking box which includes a beverage carton for holding a fluid beverage therein. A pair of handles are coupled to opposite sides of the beverage carton.

Still yet another object of the present invention is to provide a new beverage drinking box that includes handles for permitting a user to easily hold on to the drinking box, which in turn, helps reduce the chance of a user accidentally tipping the drinking box over. The handles also eliminate the need to obtain a separate holder for the drinking box.

Even still another object of the present invention is to provide a new beverage drinking box that helps prevent a user from accidentally squeezing the drinking box so that the beverage is squirted out of the straw opening of the box when the user is holding it.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
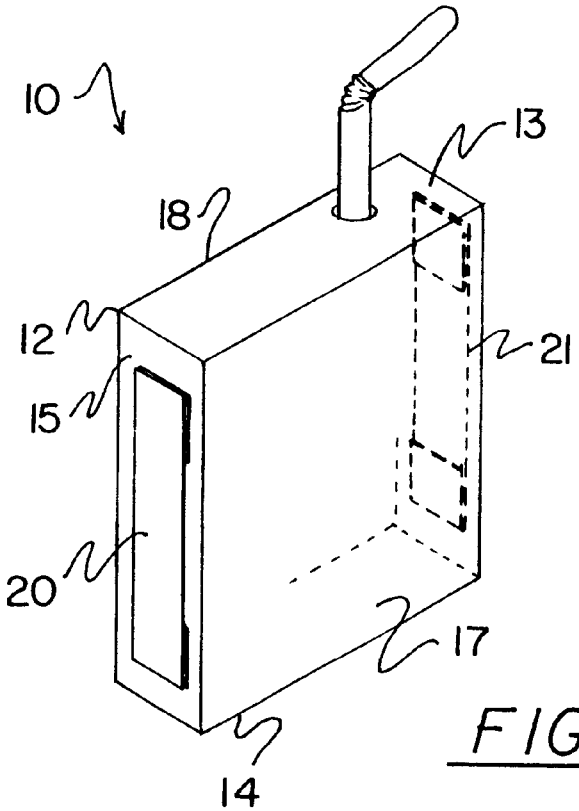
FIG. 1 is a schematic perspective view of a new beverage drinking box according to the present invention.

With reference now to the drawings, and in particular to FIGS. 1 through 4 thereof, a new beverage drinking box embodying the principles and concepts of the present invention and generally designated by the reference numeral 10 will be described.

As best illustrated in FIGS. 1 through 6, the beverage drinking box 10 generally comprises a beverage carton 12 for holding a fluid beverage therein. A pair of handles 20,21 are coupled to opposite sides 15,16 of the beverage carton 12.

In closer detail, the beverage carton 12 is designed for holding a fluid beverage therein. The beverage carton 12 is preferably generally rectangular and has rectangular top and bottom ends 13,14, a pair of spaced apart generally rectangular sides 15,16, and generally rectangular front and back faces 17,18. The sides 15,16 of the beverage carton 12 extend between the ends 13,14 of the beverage carton 12 while the faces 17,18 of the beverage carton 12 extended between the ends 13,14 of the beverage carton 12 and the sides 15,16 of the beverage carton 12.

The drinking box 10 also includes a pair of handles 20,21 for permitting a user to hold on to rather than having to grasp the actual beverage carton 12. One handle 20 is coupled to one of the sides 15 of the beverage carton 12 while the other handle 21 is coupled to the other side 16 of the beverage carton 12. Each of the handles 20,21 has a main portion 22,25 and a pair of arm portions 23,24,26,27 extending from the main portion 22,25. The arm portions 23,24,26,27 of each handle are coupled to the side of the beverage carton 12 associated with the respective handle. The main portion 22,25 is generally rectangular and has a pair of opposite ends. Preferably, one of the ends of each main portion 22,25 is positioned towards one of the ends of the beverage carton 12 while the other end of each main portion 22,25 is positioned towards the other end of the beverage carton 12.

Figure 2:
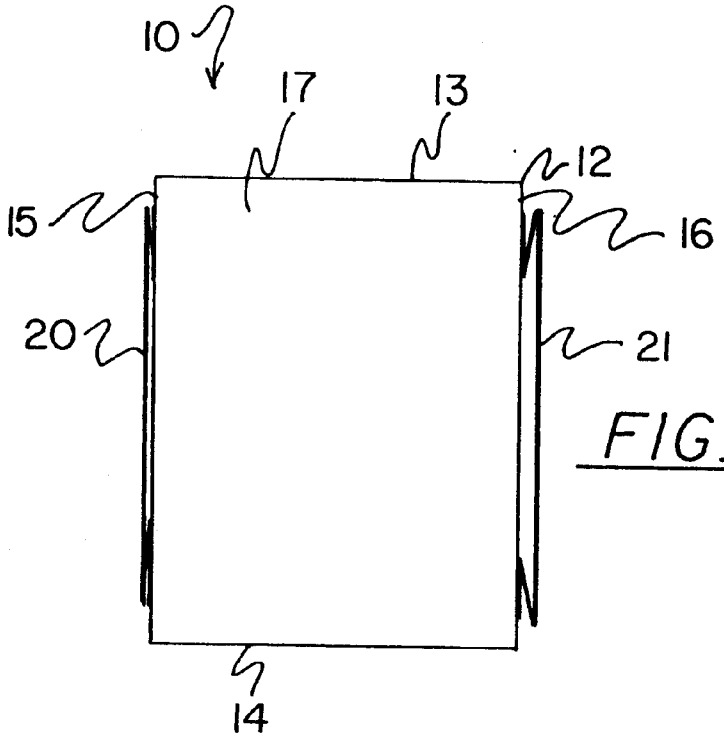
FIG. 2 is a schematic front view of the present invention with the handles in their folded positions.
Figure 3:
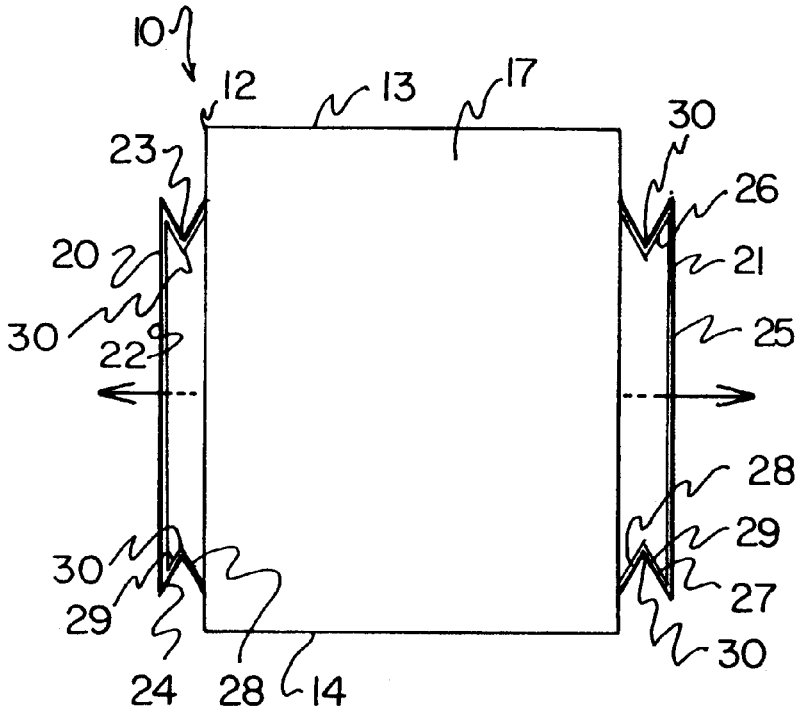
FIG. 3 is a schematic front view of the present invention with the handles being extended from their folded positions towards their extended positions.
Figure 4:
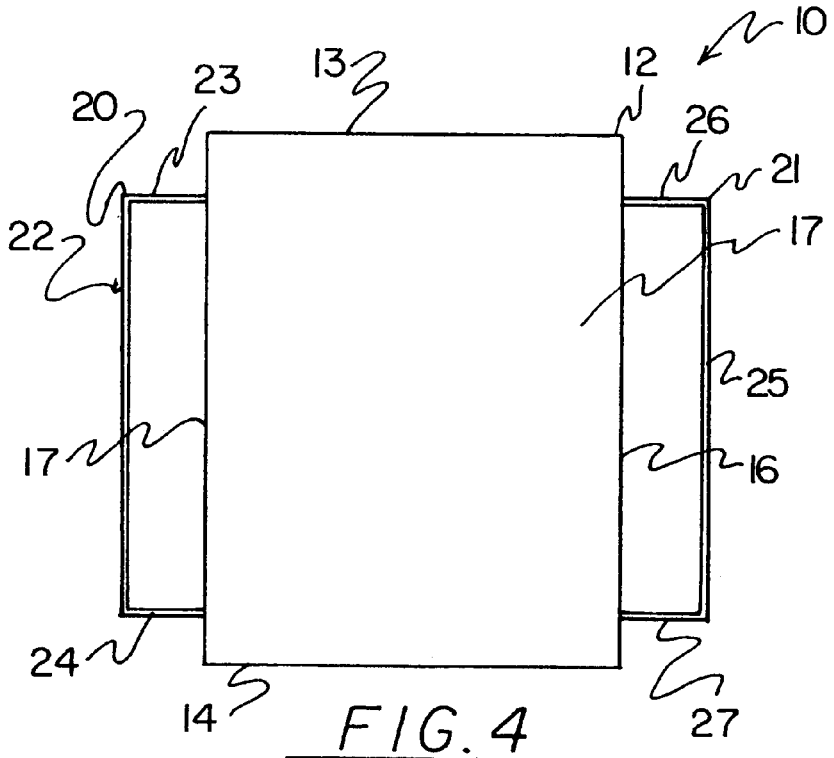
FIG. 4 is a schematic front view of the present invention with the handles in the extended position.

The arm portions 23,24,26,27 are generally rectangular with one of the arm portions 23,26 positioned adjacent one of the ends of the main portions 22,25 and the other arm portions 24,27 positioned adjacent the other end of the main portion 22,25. Each of the arm portions 23,24,26,27 has proximal and distal regions 28,29. The proximal regions 28 of the arm portions 23,24,26,27 are positioned adjacent the associated side of the beverage carton. The distal regions 29 of the arm portions 23,24,26,27 are positioned adjacent the associated main portion 22,25 of the respective handle. As illustrated in the Figures, each of the arm portions 23,24, 26,27 has a fold 30 between the distal and proximal regions 29,28. The folds permit folding of the arm portions 23,24, 26,27 between a folded, or collapsed, position (FIGS. 1 and 2) and an extended, or deployed, position (FIG. 4). As illustrated in FIGS. 1 and 2, the main portion 22,25 of each of the handles 20,21 is positioned adjacent the associated side of the beverage carton 12 of the respective handle when each arm portion is positioned in the folded position. As illustrated in FIG. 4, the main portion 22,25 of each of the handles 20,21 is spaced apart from the associated side of the beverage carton 12 of the respective handle when each arm portion is positioned in the extended position. In use, the handles may be best gripped by a user when the handles are in their extended positions. Ideally, the main portions 22,25 of the handles 20,21 lie in planes generally parallel to their associated side of the beverage carton of the respective handle.

Each of the handles 20,21 has a length defined between the ends 13,14 of the main portion 22,25 of the handle. Preferably, the length of each handle is greater than about 2 inches. Ideally, the length of each handle is about 3¼ inches. Also in the ideal embodiment, the main portion 22,25 of each of the handles 20,21 is preferably spaced apart from the associated side of the beverage carton 12 at least about ½ inch when the arm portions 23,24,26,27 of each handle are in the extended position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A drinking box, comprising:

a beverage carton for holding a fluid beverage therein, said beverage carton being generally rectangular and having a pair of spaced apart generally rectangular ends and a pair of spaced apart generally rectangular sides extending between said ends of said beverage carton; and a pair of handles, one of said handles being coupled to one of said sides of said beverage carton, another of said handles being coupled to another of said sides of said beverage carton.

2. The drinking box of claim 1, wherein each of said handles has a main portion and a pair of arm portions extending from said main portion, said arm portions of each handle being coupled to the side of the beverage carton associated with the respective handle.

3. The drinking box of claim 2, wherein said main portion is generally rectangular and has a pair of opposite ends, one of said ends of each main portion being positioned towards one of said ends of said beverage carton, another of said ends of each main portion being positioned towards another of said ends of said beverage carton.

4. The drinking box of claim 3, wherein said arm portions are generally rectangular, one of said arm portions being positioned adjacent one of said ends of said main portion, another of said arm portions being positioned adjacent another end of said main portion.

5. The drinking box of claim 2, wherein each of said arm portions having a proximal and distal regions, said proximal regions of said arm portions being positioned adjacent the associated side of said beverage carton, said distal regions of said arm portions being positioned adjacent the associated main portion of the respective handle, each of said arm portions having a fold between said distal and proximal regions, said folds permitting folding of said arm portions between a folded position and an extended position.

6. The drinking box of claim 5, wherein said main portion of each of said handles is positioned adjacent the associated side of said beverage carton of the respective handle when each arm portion is positioned in said folded position, and wherein said main portion of each of said handles is spaced apart from the associated side of said beverage carton of the respective handle when each arm portion is positioned in said extended position.

7. The drinking box of claim 2, wherein said main portions of said handles lie in planes generally parallel to the associated side of the beverage carton of the respective handle.

8. The drinking box of claim 2, wherein each of said handles has a length defined between said ends of said main portion of said handle, wherein said length of each handle is greater than about 2 inches.

9. The drinking box of claim 8, wherein said length of each handle is about 3¼ inches.

10. The drinking box of claim 6, wherein said main portion of each of said handles is spaced apart from the associated side of said beverage carton at least about ½ inch when said arm portions of each handle are in said extended position.

11. A drinking box, comprising:

a beverage carton for holding a fluid beverage therein, said beverage carton being generally rectangular and having a pair of spaced apart generally rectangular ends, a pair of spaced apart generally rectangular sides, and a pair of spaced apart generally rectangular faces;

said sides of said beverage carton being extended between said ends of said beverage carton, said faces of said beverage carton being extended between said ends of said beverage carton and said sides of said beverage carton;

a pair of handles, one of said handles being coupled to one of said sides of said beverage carton, another of said handles being coupled to another of said sides of said beverage carton;

each of said handles having a main portion and a pair of arm portions extending from said main portion, said arm portions of each handle being coupled to the side of the beverage carton associated with the respective handle;

said main portion being generally rectangular and having a pair of opposite ends, one of said ends of each main portion being positioned towards one of said ends of said beverage carton, another of said ends of each main portion being positioned towards another of said ends of said beverage carton;

said arm portions being generally rectangular, one of said arm portions being positioned adjacent one of said ends of said main portion, another of said arm portions being positioned adjacent another end of said main portion;

each of said arm portions having a proximal and distal regions;

said proximal regions of said arm portions being positioned adjacent the associated side of said beverage carton, said distal regions of said arm portions being positioned adjacent the associated main portion of the respective handle;

each of said arm portions having a fold between said distal and proximal regions, said folds permitting folding of said arm portions between a folded position and an extended position;

said main portion of each of said handles being positioned adjacent the associated side of said beverage carton of the respective handle when each arm portion is positioned in said folded position;

said main portion of each of said handles being spaced apart from the associated side of said beverage carton of the respective handle when each arm portion is positioned in said extended position;

said main portions of said handles lying in planes generally parallel to the associated side of the beverage carton of the respective handle;

each of said handles having a length defined between said ends of said main portion of said handle, wherein said length of each handle is about 3¼ inches; and wherein said main portion of each of said handles is spaced apart from the associated side of said beverage carton at least about ½ inch when said arm portions of each handle are in said extended position.

* * * * *